US005816682A

United States Patent [19]

Marischen

[11] Patent Number: 5,816,682

[45] Date of Patent: Oct. 6, 1998

[54] ELECTRICAL RECEPTACLE FACEPLATE WITH BUILT-IN NIGHTLIGHT

[75] Inventor: Joseph E. Marischen, Austin, Tex.

[73] Assignee: Austin Innovations, Incorporated, Austin, Tex.

[21] Appl. No.: 694,698

[22] Filed: Aug. 9, 1996

[51] Int. Cl.[6] ..... F21V 9/16

[52] U.S. Cl. ..... 362/84; 362/95; 362/276

[58] Field of Search ..... 362/34, 84, 95, 362/226, 276, 802; 439/490, 536; 174/66; 200/310

[56] References Cited

U.S. PATENT DOCUMENTS

| | | | |
|---|---|---|---|
| D. 284,109 | 6/1986 | Seal, Jr. | D26/72 |
| D. 340,001 | 10/1993 | Watkins | D10/114 |
| 1,116,292 | 11/1914 | Juan . | |
| 2,004,039 | 6/1935 | Despard | 439/536 |
| 3,061,716 | 10/1962 | Benander | 362/95 |
| 3,121,817 | 2/1964 | Saviers | 313/108 |
| 3,243,587 | 3/1966 | Relich | 240/73 |
| 3,307,030 | 2/1967 | De Francisco | 362/95 |
| 3,588,489 | 6/1971 | Gaimes | 362/95 |
| 4,000,405 | 12/1976 | Horwinski | 240/2 SP |
| 4,038,582 | 7/1977 | Horwinski | 315/129 |
| 4,323,953 | 4/1982 | Hutchison | 362/226 |
| 4,514,789 | 4/1985 | Jester | 362/95 |
| 4,549,250 | 10/1985 | Spector | 362/96 |
| 4,617,613 | 10/1986 | Rice | 362/95 |
| 4,755,913 | 7/1988 | Sleveland | 362/95 |
| 4,792,882 | 12/1988 | Guevremont | 362/72 |
| 4,841,288 | 6/1989 | Addicks | 340/690 |
| 5,397,869 | 3/1995 | Huen | 200/330 |
| 5,457,286 | 10/1995 | Flasz | 174/66 |
| 5,481,442 | 1/1996 | Dickie et al. | 362/95 |
| 5,660,459 | 8/1997 | Appelberg | 362/84 |

FOREIGN PATENT DOCUMENTS

| | | |
|---|---|---|
| 775 327 | 10/1934 | France . |
| 2 128 313 | 4/1984 | United Kingdom . |

OTHER PUBLICATIONS

Barrie Lighting, Elan Wall Light AD, Rec'd 1987, Wall Light (group 2900 Wall Light Box).

Six photographs of Panelescent Nite–Lite by Sylvania taken by Applicant.

Better Homes & Gardens, Sylvania Night Light (Group 2900—Special Purpose Lamp Box), p. 78, Dec. 1960.

Light & Lighting (England), hexagonal lens, #11 (Group 2900—Wall Lamp Box), p. 367, Dec. 1962.

*Primary Examiner*—Y My Quach

*Attorney, Agent, or Firm*—Arnold White & Durkee

[57] ABSTRACT

An electrical receptacle faceplate that has a built-in nightlight which does not need or use an electrical socket. More specifically, a nightlight used in conjunction with an electrical light switch or outlet without need for an electrical socket or alteration to the electrical receptacle or hole containing the receptacle.

12 Claims, 4 Drawing Sheets

ELECTRICAL RECEPTACLE FACEPLATE WITH BUILT-IN NIGHTLIGHT

BACKGROUND OF THE INVENTION

1. Field of the Invention

This invention relates to the fields of electrical receptacles (i.e. outlets, switches, dimmers, keypads, etc.) and nightlights. More particularly, it relates to an adapter for use with an electrical receptacle which provides a nightlight that does not need or use an electrical socket nor require alterations to the existing receptacle of hole which contains the receptacle.

2. Discussion of the Prior Art

Traditionally, nightlights have been plugged into existing wall outlets resulting in the loss of use of one of the wall outlets. In addition, no technology has been offered to allow the use of a nightlight with electrical wall receptacles other than wall sockets. Adaptations were made in the form of cube taps which were used in one outlet of a duplex wall receptacle, with the nightlight being inserted in one of the sockets of the cube tap. This adaptation enabled the use of the nightlight and returned use of multiple outlets. The problem with cube taps is that they tend to be bulky, often work loose resulting in poor connection, and are not aesthetically pleasing.

Further adaptations in this technology evolved in the form of single unit electrical adapter and nightlight combinations. See e.g., Horwinski, U.S. Pat. No. 4,000,405. This technology solved the problem of maintaining outlets open, while providing a nightlight. However, many embodiments were cumbersome, not aesthetically pleasing, required replacing the existing outlet with another, and sometimes required enlarging the outlet box hole. In addition, it did not solve the problem of adding a nightlight to other electrical wall receptacles other than sockets.

SUMMARY OF THE INVENTION

This invention describes a nightlight which may be used in conjunction with an electrical outlet without utilizing one of the sockets. This invention may also be used with an electrical light switch, dimmer switch, or the like. This invention may be used in conjunction with an existing electrical receptacle without modifying or replacing the receptacle or enlarging the hole which contains the receptacle.

The present invention is a nightlight for use with an electrical receptacle faceplate. More specifically the invention is a flat nightlight having a mount for attaching itself adjacent to, but apart from an electrical faceplate (i.e. the nightlight is next to, but not directly behind the faceplate). The invention also has an electrical conduit for providing electricity from the receptacle to the nightlight without interfering in the use of the receptacle. That is, when the invention is used in conjunction with an electrical outlet, it does not require the use of one of the sockets.

Another embodiment of the invention makes use of a faceplate with two openings adjacent to one another. One opening is dimensioned to fit around the existing electrical receptacle when said faceplate is attached flush to the receptacle. The second opening fits around the nightlight. The nightlight does not require the use of an outlet, and thus, when used in conjunction with an electrical socket all sockets continue to be available.

The invention may be used in conjunction with a timer connected to the nightlight to allow intermittent or continuous lighting. The invention may also be used with a proximity sensor connected to the nightlight for activating the nightlight when a body is present.

BRIEF DESCRIPTION OF THE DRAWINGS

So that the manner in which the above recited advantages and features of the present invention, as well as others which will become apparent, are attained and can be understood in detail, a more particular description of the invention summarized above may be had by reference to a preferred embodiment thereof which is illustrated in the appended drawings, which drawings form a part of this specification.

It is noted, however, that the appended drawings illustrate only typical embodiments of the invention and are therefore not to be considered limiting of its scope, for the invention may admit to other equally effective embodiments.

DESCRIPTION OF ILLUSTRATIVE EMBODIMENTS

Figure 1:
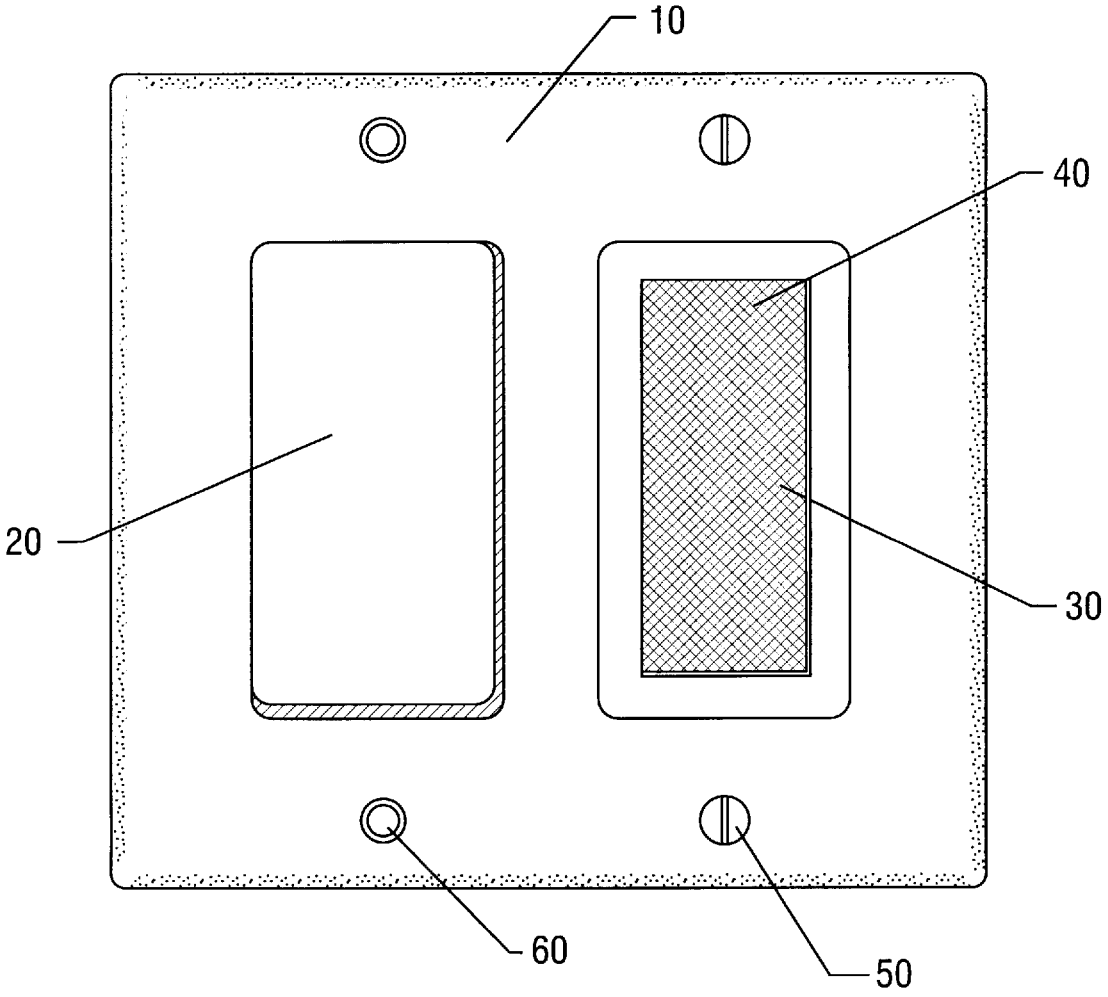
FIG. 1 is a drawing of a front view of an illuminated faceplate for covering electrical receptacles according to this invention.
Figure 2:
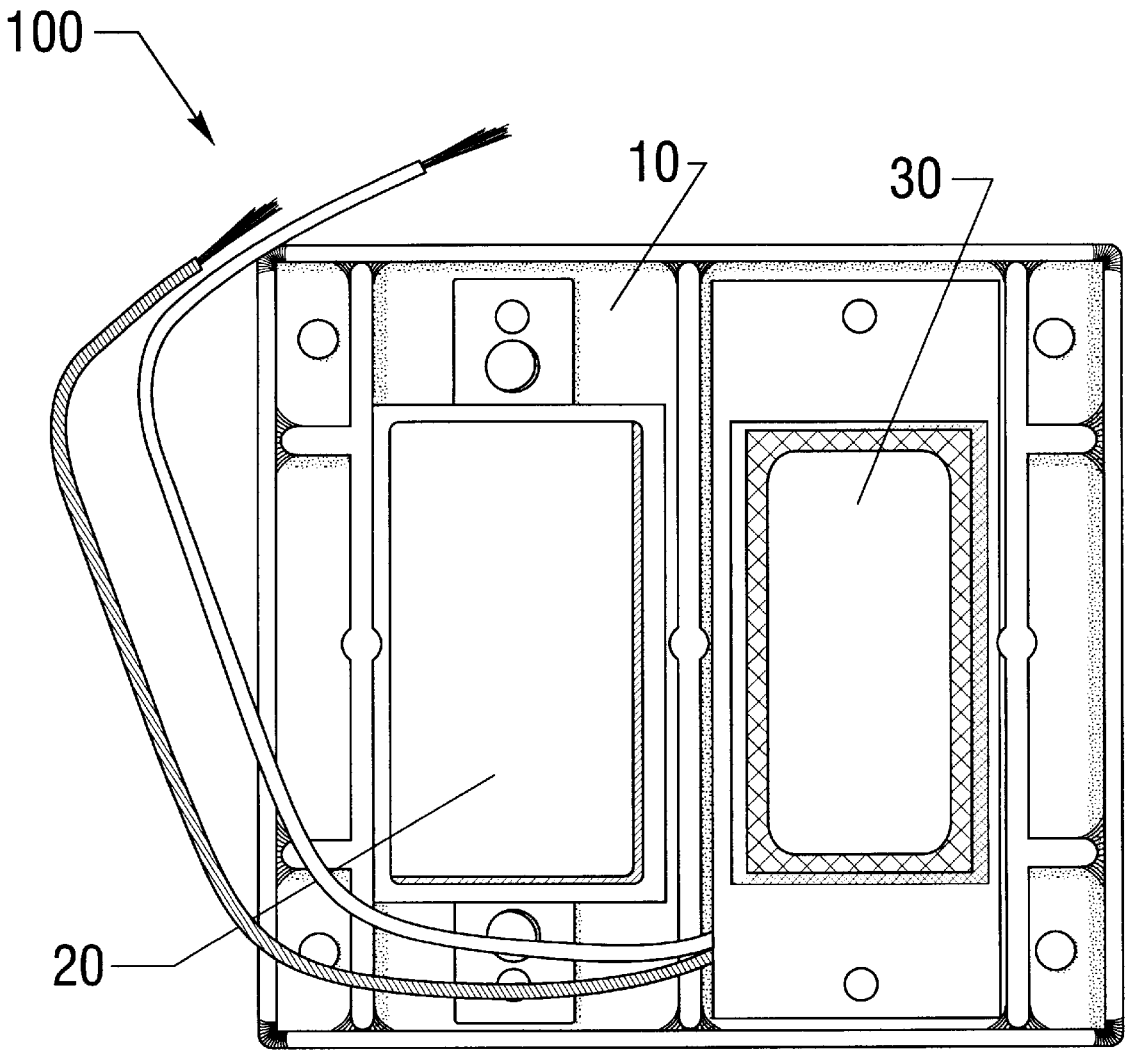
FIG. 2 is a drawing of a back view of the illuminated faceplate of FIG. 1.

FIGS. 1 and 2 illustrate the features of an illuminated faceplate that exemplifies a preferred embodiment of this invention. An electrical faceplate 10 defining a first opening 20 dimensioned to fit around an electrical wall receptacle, and a second opening 40 dimensioned to fit around the flat nightlight 30. The nightlight 30 is rigidly attached to the electrical faceplate with screws 50 or by other means such as glue, double-sided tape, welding, etc. Alternatively, the nightlight 30 may be an integral part of the faceplate 10. One advantage of mounting the nightlight 30 to the faceplate 10 is ease of manufacturing and allows use of a standard faceplate 10.

Figure 3:
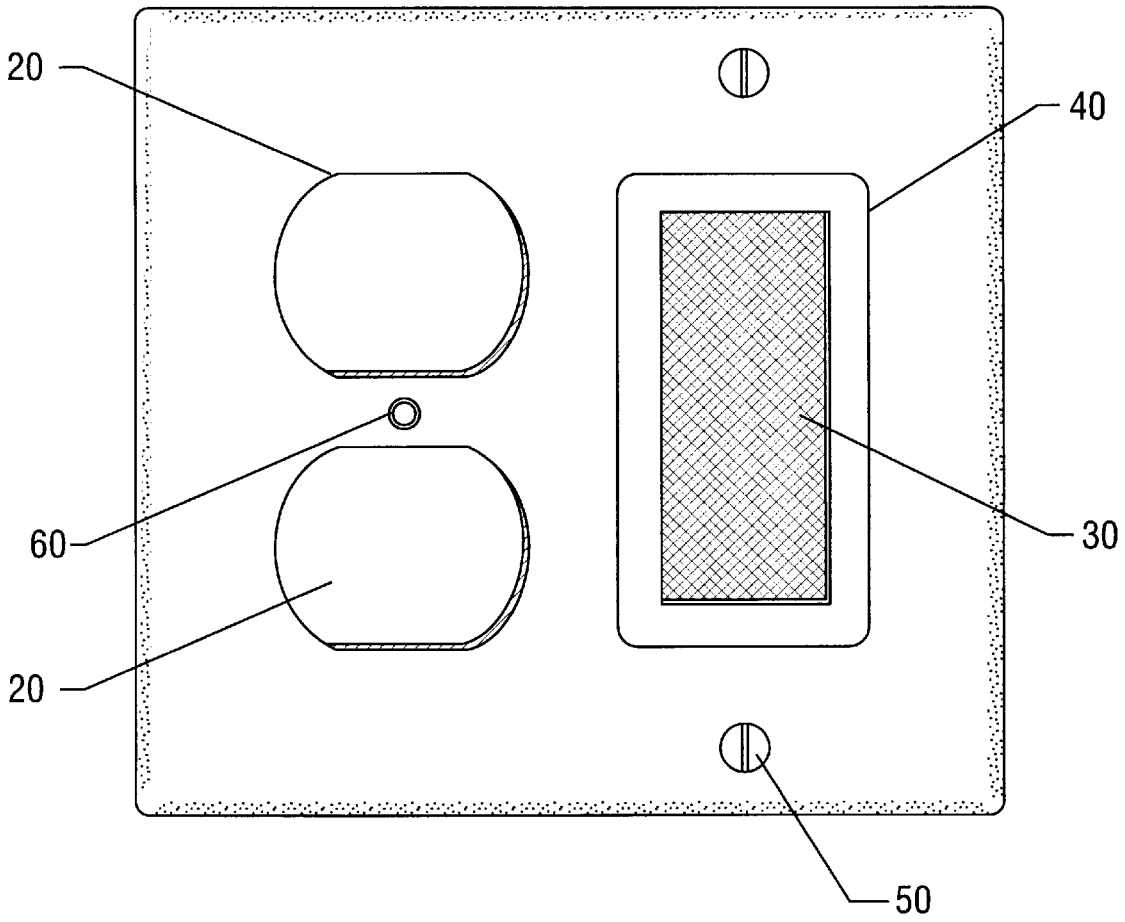
FIG. 3 is a drawing of a front view of an illuminated faceplate for covering electrical receptacles according to this invention.

The illuminated faceplate (i.e. the electrical faceplate 10 combined with the nightlight 30) may then be attached to a wall using screws 60 or other means. The shape of the first opening 20 may assume any shape necessary to fit around a given electrical wall receptacle. FIG. 3 depicts an embodiment having a first opening 20 which is compatible with many standard wall sockets. FIG. 1 depicts an embodiment which is compatible with some standard wall sockets and light switches. Likewise, faceplates for multiple sockets and multiple switches may be used. As well as faceplates for dimmer switches, security system keypads, or the like. The faceplates may be of any color or decorative design. They may be manufactured out of plastic, wood, metal, or other appropriate material.

The nightlight 30 must be flat enough to allow the faceplate 10 to be attached flush to the wall without modifying the electrical receptacle or the hole which contains the receptacle, although, the nightlight 30 may protrude in front of the faceplate 10. The nightlight 30 may assume any shape, design, or color. Preferably, the nightlight 30 is dimensioned to fit into the opening of a standard electrical faceplate 10. The nightlight may be any of any type so long as it is flat enough to allow the faceplate 10 to mount flush to the wall. In particular, an electroluminescent nightlight is preferred because of its flat shape, equal light distribution as opposed to a point light source, and low power usage. When using a low power nightlight, such as an electroluminescent device, the nightlight may be directly patched into the existing electrical receptacle through the use of electrical wires 100 or some other electrical conductor. If the nightlight requires a substantial amount of power, it may be necessary to bypass or supplement the power available from the existing electrical receptacle with batteries or the like.

Figure 4:
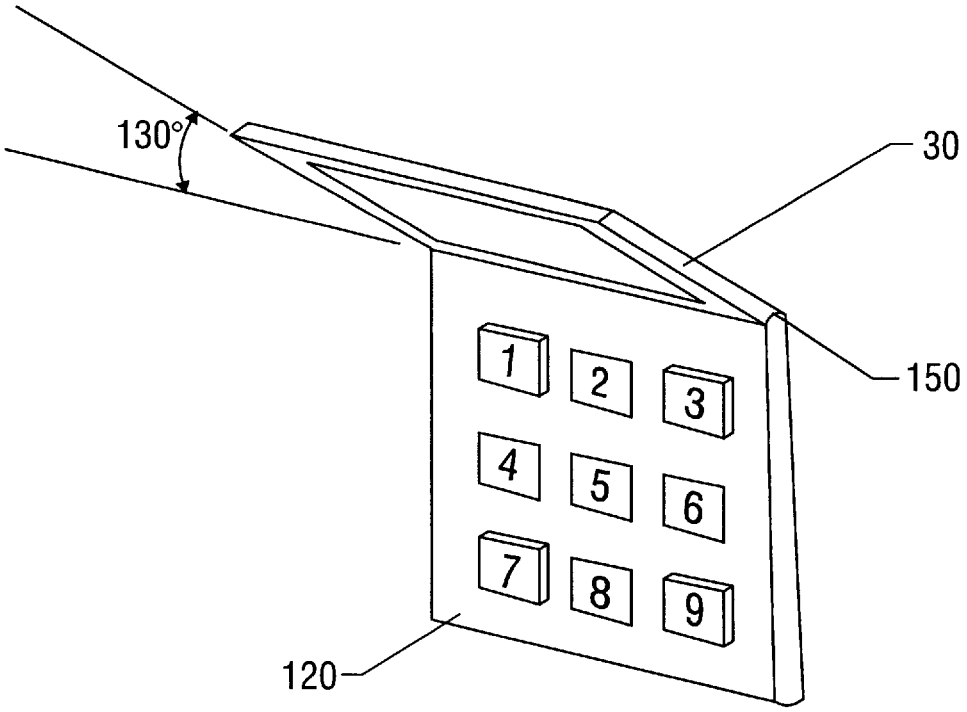
FIG. 4 is a drawing of a nightlight for use with an existing electrical receptacle faceplate.

FIG. 4 illustrates the features of a nightlight that exemplifies a preferred embodiment of this invention. Rather than replacing the existing faceplate 120 with an enlarged faceplate 10, the nightlight 30 may be adaptable for use with an existing faceplate 120. This may be accomplished, for example, by creating a nightlight 30 which snaps onto or in some way attaches to the existing faceplate 120. For example the nightlight 30 may have a mount 150 which clips or screws onto the back of the existing faceplate 120. Alternatively, the mount 150 may slide onto the faceplate 120 such that it may only be removed after removing the faceplate 120 from the receptacle. The mount 150 may be an integral part of the nightlight 30 or may separate from the nightlight 30. The mount 150 may attach the nightlight 30 to the faceplate 120 such that the back of the nightlight 30 is flush to the wall, or at an angle 130 to the faceplate 120. Alternatively, still the mount 150 may be adjustable such that the angle 130 may be varied.

This alternative embodiment may be useful when the existing faceplate 120 is of a non-standard shape. This embodiment may also be helpful when it is desirable to direct the nightlight 30 toward the existing faceplate 120. For example, when illuminating an electronic keypad. In this regard, the mounting means 150 may be adjustable allowing variability in the angle 130 formed between the nightlight 30 and the faceplate 120.

What is claimed is:

1. An illuminated faceplate comprising:

a faceplate defining a first opening and a second opening adjacent to one another, said first opening dimensioned to allow access to an electrical receptacle when said faceplate is attached flush to said receptacle;

a flat electroluminescent device to provide low-intensity lighting suitable for use as a nightlight, said electroluminescent device being dimensioned to fit into said second opening of said faceplate when attached to said faceplate; and an electrical conduit for delivering electricity to said electroluminescent device from said receptacle without plugging said electroluminescent device into said receptacle.

2. The apparatus of claim 1, further comprising a timer connected to said electroluminescent device.

3. The apparatus of claim 1, further comprising a proximity sensor connected to said electroluminescent device for activating said electroluminescent device.

4. A nightlight for use with a receptacle having a faceplate comprising:

a flat nightlight having a mount attaching said nightlight laterally adjacent to and apart from said faceplate; and an electrical conduit for providing electricity from said receptacle to said nightlight without plugging said flat nightlight into said receptacle.

5. The apparatus of claim 4, wherein said nightlight comprises an electroluminescent device.

6. The apparatus of claim 4, further comprising a timer connected to said nightlight.

7. The apparatus of claim 4, further comprising a proximity sensor connected to said nightlight for triggering for activating said nightlight.

8. The apparatus of claim 4, wherein said mount attaches said nightlight at an angle to said faceplate.

9. The apparatus of claim 4, wherein said mount is adjustable allowing an angle between said faceplate and said nightlight to vary.

10. An illuminated faceplate for covering an electrical receptacle, said illuminated faceplate comprising:

an electrical faceplate defining a first opening and a second opening, said first opening dimensioned to allow access to said electrical receptacle;

a flat nightlight rigidly attached to said electrical faceplate, such that the light from said nightlight passes through said second opening; and a mount for attaching said electrical faceplate flush to said electrical receptacle.

11. Apparatus of claim 10, wherein said electrical faceplate is a standard double faceplate.

12. Apparatus of claim 10, wherein said mount consists of two screws.

* * * * *